US010703450B2

(12) United States Patent
Maki

(10) Patent No.: US 10,703,450 B2
(45) Date of Patent: Jul. 7, 2020

(54) IMMERSION SURVIVAL SUIT

(71) Applicant: Immanuel Pauli Maki, Boynton Beach, FL (US)

(72) Inventor: Immanuel Pauli Maki, Boynton Beach, FL (US)

( * ) Notice: Subject to any disclaimer, the term of this patent is extended or adjusted under 35 U.S.C. 154(b) by 490 days.

(21) Appl. No.: 15/491,805

(22) Filed: Apr. 19, 2017

(65) Prior Publication Data

US 2017/0283019 A1 Oct. 5, 2017

Related U.S. Application Data

(63) Continuation-in-part of application No. 14/493,514, filed on Sep. 23, 2014, now abandoned.

(51) Int. Cl.

| | |
|---|---|
| ***B63C 11/18*** | (2006.01) |
| ***B63C 11/06*** | (2006.01) |
| ***B63C 11/04*** | (2006.01) |
| ***B63C 11/20*** | (2006.01) |
| ***B63C 11/16*** | (2006.01) |
| ***A62B 18/04*** | (2006.01) |
| ***A62B 17/00*** | (2006.01) |

(52) U.S. Cl.

CPC ..... *B63C 11/186* (2013.01); *B63C 11/04* (2013.01); *B63C 11/06* (2013.01); *B63C 11/16* (2013.01); *B63C 11/205* (2013.01); *A62B 17/006* (2013.01); *A62B 18/04* (2013.01); *B63C 2011/043* (2013.01); *B63C 2011/165* (2013.01)

(58) Field of Classification Search

CPC ..... B63C 11/186; B63C 11/06; B63C 9/087; B63C 9/105; B63C 9/125; B63C 9/13; B63C 9/15; B63C 9/18; B63C 9/1255; B63C 11/04; B63C 11/08; B63C 2011/085; A63B 33/00; A61B 17/006

See application file for complete search history.

(56) References Cited

U.S. PATENT DOCUMENTS 2,792,832 A * 5/1957 Galeazzi ..... B63C 11/06 128/201.27
RE25,122 E * 2/1962 Page ..... B63C 11/2209 128/205.24
2015/0284061 A1* 10/2015 Anderson ..... B63C 11/04 405/186

* cited by examiner

*Primary Examiner* — Timothy A Stanis
*Assistant Examiner* — Cana A Gallegos
(74) *Attorney, Agent, or Firm* — William G. Heedy; The Van Winkle Law Firm

(57) ABSTRACT

A survival helmet device for use in combination with a survival suit includes a helmet, inhale and exhale control valves, and at least one inflatable air cavity pocket secured to the survival suit for selectively controlling the air supply and buoyancy of the survival helmet device and the survival suit.

9 Claims, 9 Drawing Sheets

IMMERSION SURVIVAL SUIT

RELATED APPLICATION

This application is a Continuation-in-Part Application of co-pending U.S. Non-Provisional patent application Ser. No. 14/493,514 filed on Sep. 23, 2014.

BACKGROUND OF THE INVENTION

The present invention relates to immersion survival suits for use in water and, more particularly, to a helmet device for use in combination with an immersion survival suit.

Immersion survival suits are used to keep a person thermally insulated when in water and are typically stowed on board ships in easily accessible locations. In the event that a ship is sinking or capsized, each person aboard the ship retrieves a suit and puts it on (over their clothing) before abandoning the ship. Immersion survival suits are generally one-size-fits-all while other come in three sizes, and include built-on boots, gloves and a hood. The insulating and waterproof characteristics of the survival suits typically extend a wearer's average survival time in open water by several hours while awaiting rescue.

Survival suits may include an open neck design, wherein a zipper or other fastener is used to close the opening in order to prevent water from entering the suit. Alternatively, survival suits may include a closed neck design, wherein a form-fitting neck and chin portion serves to seal out water. In the past, suits have been equipped with multiple air pockets that are inflatable by mouth through hoses for assisting the user to stay afloat. More recently developed suits are equipped with compressed carbon dioxide cartridges, which rapidly inflate the suit when activated.

The present invention serves to provide a survival helmet device that is adapted for use with presently available immersion survival suits and which provides an efficient and superior method of thermally insulting the wearer's body while also keeping the wearer afloat in open water.

SUMMARY OF THE INVENTION

In accordance with one form of this invention, there is provided a survival helmet device for use in combination with a survival suit and including a helmet surrounding an internal cavity and having an opening that is sized for passage of a user's head therethrough and into the internal cavity, and the helmet being securable to the survival suit; an inhale control valve surrounding an inner channel extending between a top end and a bottom end of the inhale control valve; an inlet opening formed by the inhale control valve approximate the top end for permitting atmospheric air to flow into the inner channel and a one-way inhale valve approximate the bottom end that is structured and disposed for permitting passage therethrough of air that is directed into the inner channel from the top end of the inhale control valve; an inhale control member on the inhale control valve that is manually operable between an open position and a closed position for selectively permitting or preventing the passage of airflow through the inlet opening; an inhale hose member in the internal cavity of the helmet, and the inhale hose member being secured to the bottom end of the inhale control valve at an inhale opening on the helmet; a mouthpiece in fluid flow connection with the inhale hose member and an exhale hose member, and the mouthpiece forming a breathing port that is sized and configured for selective connection with the user's mouth; an exhale control valve surrounding an inner cavity extending between a top end and a bottom end of the exhale control valve and the exhale hose member being located in the internal cavity of the helmet and being secured to the bottom end of the exhale control valve at an exhale opening on the helmet; an outlet opening formed by the exhale control valve approximate the top end for permitting air to flow from the inner channel into the atmosphere and a one-way exhale valve approximate the bottom end that is structured and disposed for permitting passage therethrough of air from the exhale hose member into the inner cavity of the exhale control valve; an exhale control member on the exhale control valve that is manually operable between an open position and a closed position for selectively permitting or preventing the passage of airflow through the outlet opening; at least one air cavity pocket secured to the inner facing surface of the survival suit; a T-connector in the exhale hose member and a tube member having a first end extending from the T-connector and a second end extending from the at least one air cavity pocket, the tube member and the at least one air cavity pocket being in fluid flow communication with the exhale hose member; a flap valve member on the at least one air cavity pocket being operable to permit one-way entry of air into the at least one air cavity pocket and a release valve member on the at least one air cavity pocket that is operable to permit one-way exit of air into the survival suit; and wherein the user may selectively position each of the inhale and exhale control members in the open and close positions and selectively open and close the flap valve member and the release valve member to control air supply and buoyancy within the survival helmet device and the survival suit.

OBJECTS AND ADVANTAGES OF THE INVENTION

Considering the foregoing, it is a primary object of the present invention to provide a survival helmet device for facilitating thermal insulation within a coupled immersion survival suit using air exhaled by the user.

It is a further object of the present invention to provide a survival helmet device for facilitating floatation of the user of the coupled immersion survival suit using air exhaled by the user.

It is still a further object of the present invention to provide a survival helmet device for manually controlling the buoyancy level of the immersion survival suit.

It is still a further object of the present invention to provide a survival helmet device for conserving the energy of a user.

These and other objects and advantages of the present invention are more readily apparent with reference to the following detailed description and the accompanying drawings.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENTS

Referring to the several views of the drawings, the survival helmet device of the present invention is shown in combination with an immersion survival suit 100 and is generally indicated as 10.

Figure 1:
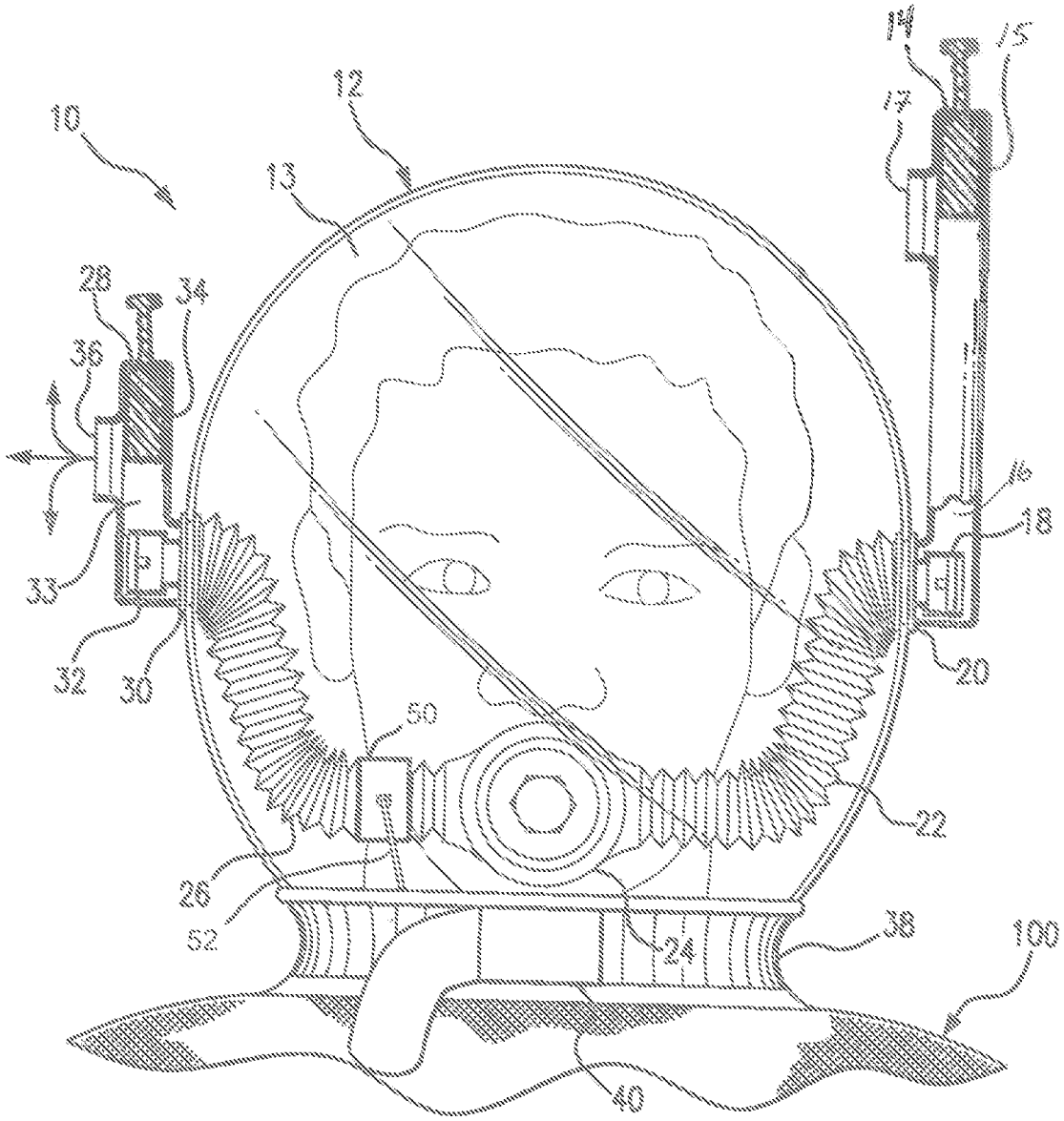
FIG. 1 is a front elevational view of the survival helmet device of the present invention when the manually operated inhale and exhale members are in the open position.

Referring initially to FIG. 1, the survival helmet device 10 includes a dome-shaped, airtight helmet 12 surrounding an internal cavity 13. In one embodiment, as shown throughout the drawings, the helmet is made from resilient, transparent material, such as acrylic. Attached to the helmet 12 is an inhale control valve 14 that includes an inner channel 16 extending the length of the inhale control valve 14. A one-way inhale valve 18 permits passage of airflow that enters the channel 16 at the top opening of the inhale control valve 14 (via the surrounding atmosphere) through an opening formed in the helmet 12 and into an inhale hose member 22. A seal 20 maintains an airtight, fluid flow connection between the inner channel 16 and the inhale hose member 22 located in the inner cavity of the helmet 12.

An inhale control member 15 is manually operable for controlling the passage of airflow through the inlet opening 17 on the inhale control valve 14 and into the internal cavity. The user may selectively operate the inhale control valve 14 between an open position by raising the inhale control member 15 for permitting airflow through the outlet opening 36 and a closed position by lowering the inhale control member 15 for preventing (i.e., blocking) airflow through the inlet opening 17.

A mouthpiece 24 is connected to the inhale hose member 22 and an exhale hose member 26, forming an airflow channel 27 extending the length of the inhale hose member 22, mouthpiece 24, and exhale hose member 26. A breathing port on the back side of the mouthpiece 24 is sized and configured to form an airtight seal between the user's mouth and the airflow channel 27. The exhale hose member 26 extends from the mouthpiece 24 through an opening on the helmet 12 and is connected to an exhale control valve 28. A seal 30 maintains an airtight connection between the airflow channel 27 and the inner cavity 33 of control member 28. A one-way exhale valve 32 permits passage of airflow into the inner cavity 33 of the exhale control valve 28 from the exhale hose member 26.

Still referring to FIG. 1, an exhale control member 34 is manually operable for controlling the passage of airflow through the outlet opening 36 on the exhale control valve 28 and into the surrounding atmosphere. The user may selectively operate the exhale control valve 34 between an open position by raising the exhale control member 34 for permitting airflow through the outlet opening 36 and a closed position by lowering the exhale control member 34 for preventing (i.e., blocking) airflow through the outlet opening 36.

A fastening member, such as a strap 38, is provided for securing an airtight connection between the helmet 12 and the metal collar 40 of the survival suit 100.

Generally, when inhaling air from the atmosphere by mouth via the inhale control valve 14 the survivor can control whether the exhaled air either goes into the suit by exhaling through his nose or into the surrounding atmosphere by exhaling through his mouth. Accordingly, the survival suit 100 can be filled with air for buoyance, insulation and/or for use as an air reservoir. A T-connector 50 is secured on the exhale hose member 26 and is in connection with a first end of a tube member 52. The opposite end of tube member 52 is in connection with front air cavity 54A and forms part of a fluid flow network including front air cavities 54A and 54B and rear air cavity 62 for controlling the buoyancy of the survival suit 100 (see FIGS. 6 and 7).

Figure 2:
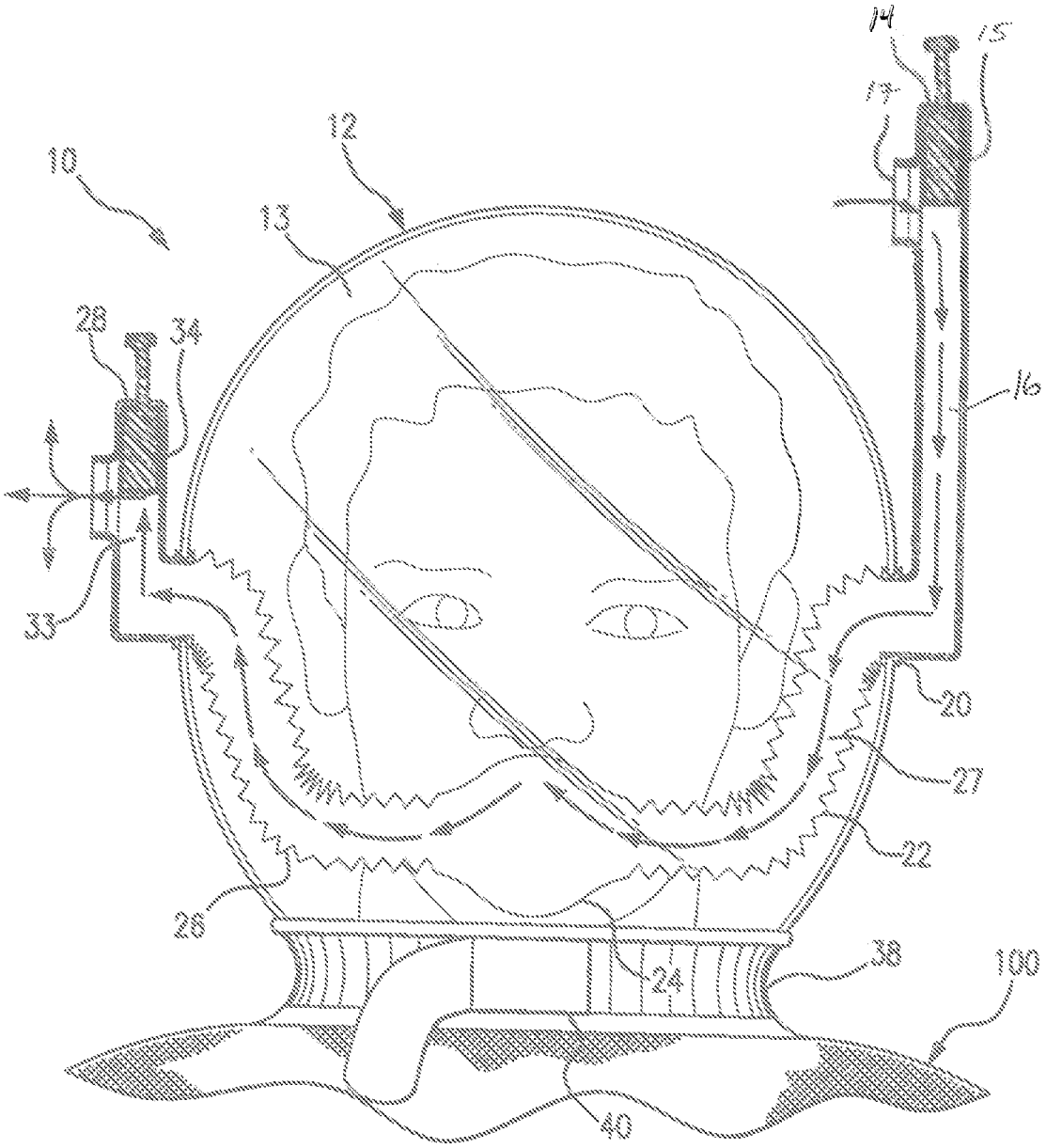
FIG. 2 is a front elevational view illustrating airflow through the survival helmet device of the present invention when the manually operated inhale and exhale members are each in the open position.

Referring to FIG. 2, the inhale control member 15 is in the open position for permitting airflow through the inlet opening 17 and the exhale control member 34 is in the open position for permitting airflow through the outlet opening 36. In operation, as the user inhales through the breathing port on the mouthpiece 24, air enters the inner channel 16, passes through the one-way intake valve 18 and into inhale hose member 22, and enters the user's mouth through the mouthpiece 24. As the user exhales into the mouthpiece 24, air enters the exhale hose member 26 and passes through the one-way exhale valve 32 and into the inner cavity 33 of the exhale control valve 28. The exhale control member 34 is manually operable for controlling release of the exhaled airflow out from the inner cavity 33 of the exhale control valve 28 and into the surrounding atmosphere.

Figure 3:
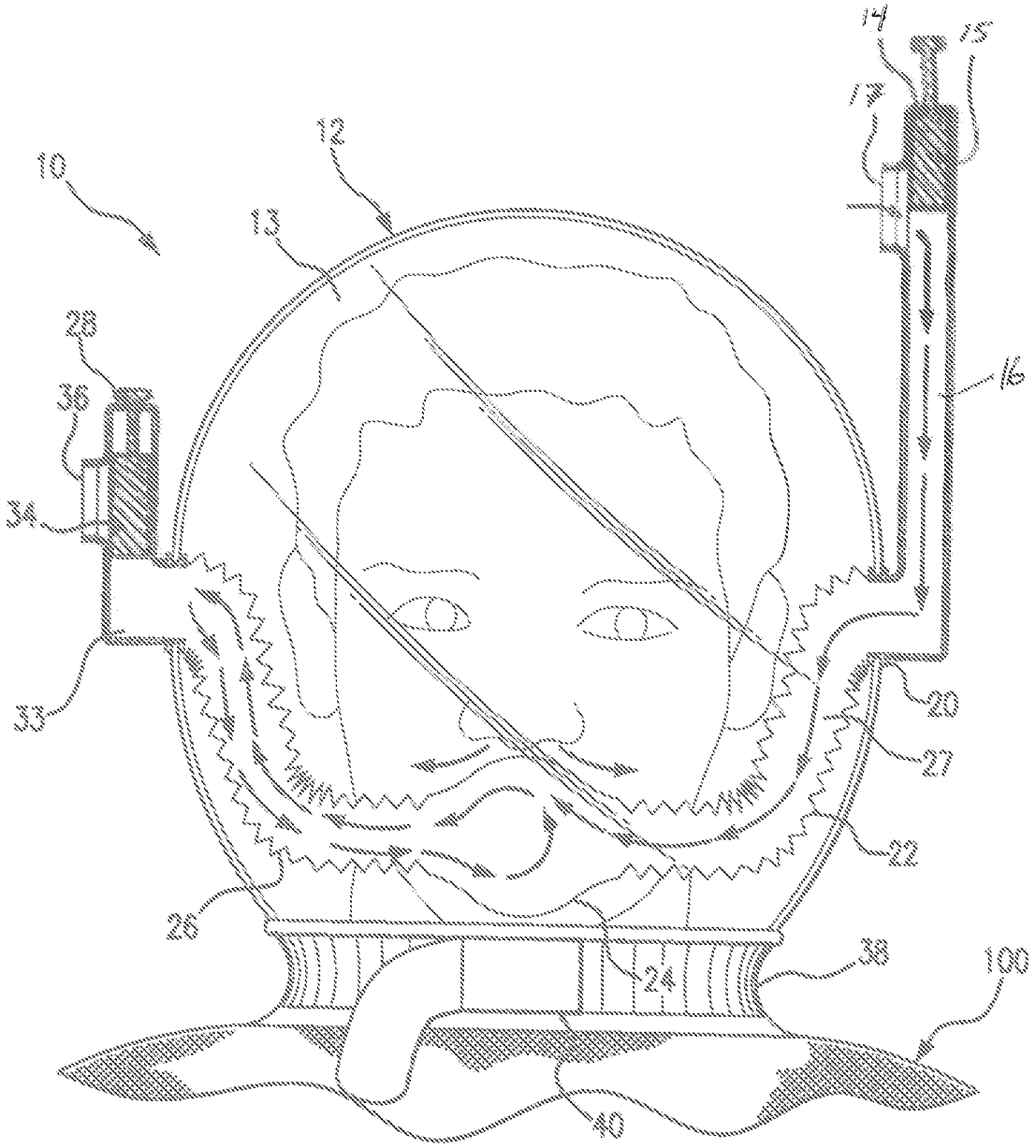
FIG. 3 is a front elevational view illustrating airflow through the survival helmet device of the present invention when the manually operated inhale member is in the open position and the manually operated exhale member is in the closed position.
Figure 6:
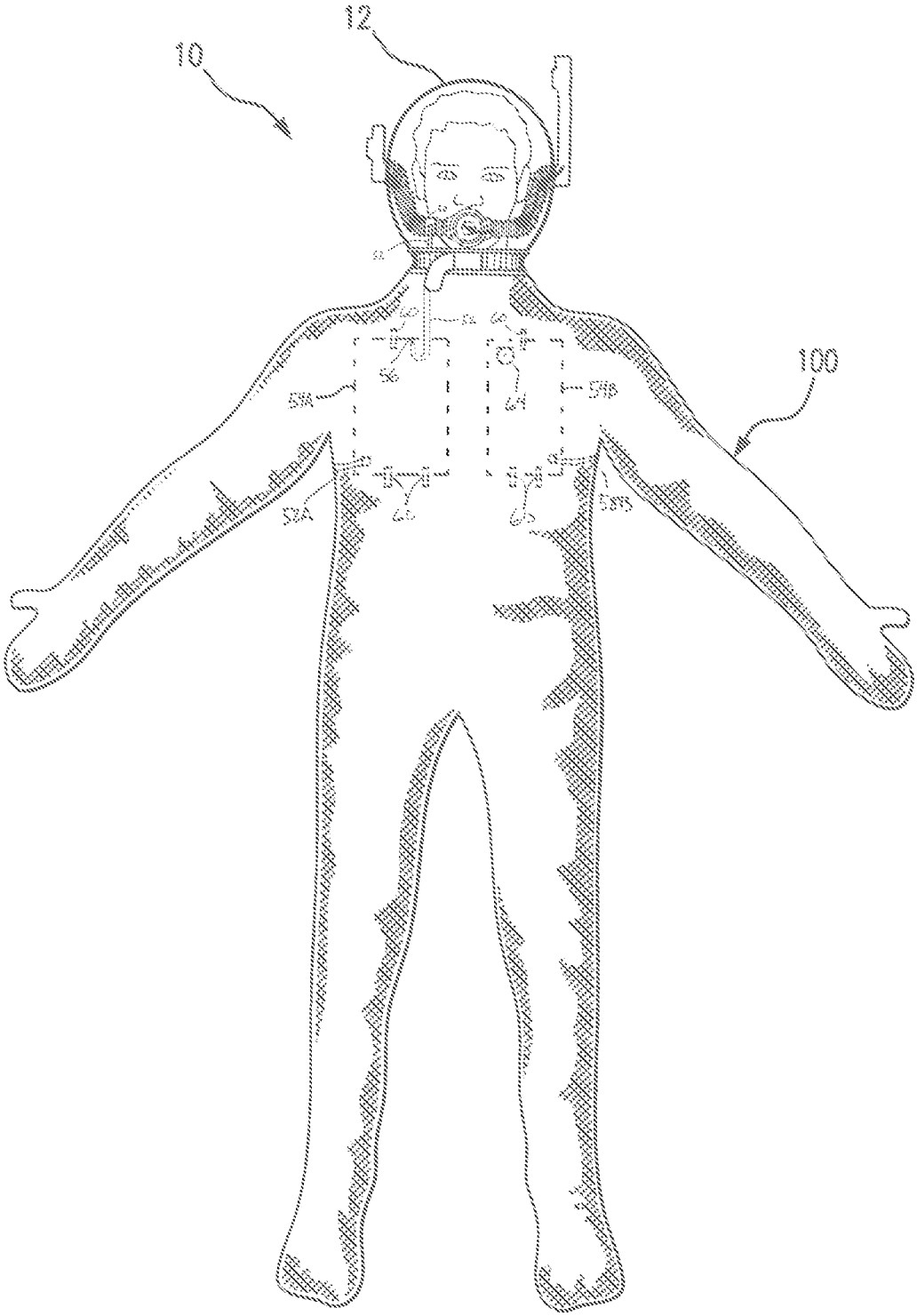
FIG. 6 is a front elevational view illustrating the survival helmet device and survival suit of the immersion survival suit.
Figure 7:
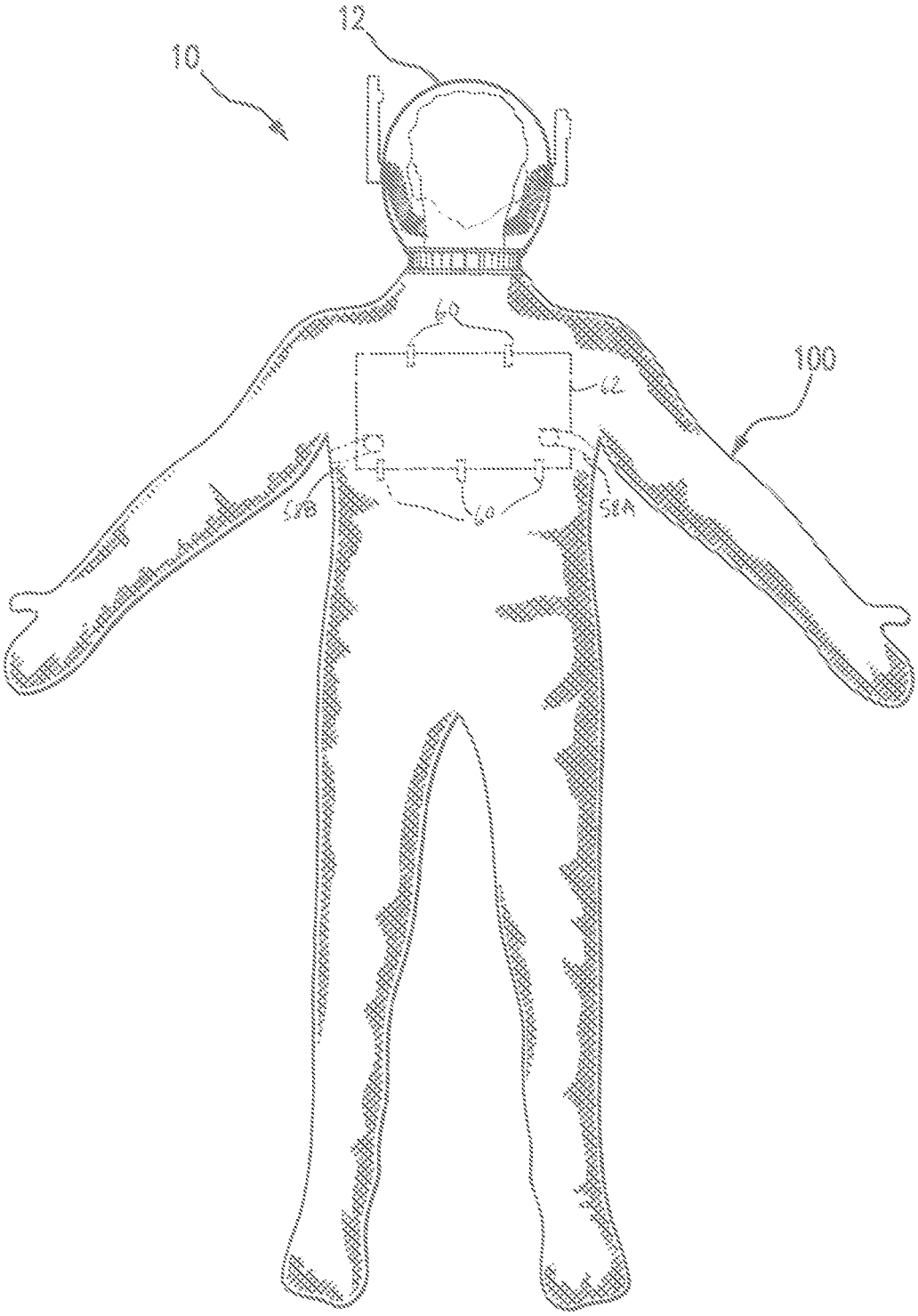
FIG. 7 is a rear elevational view illustrating the survival helmet device and survival suit of the immersion survival suit.
Figure 8:
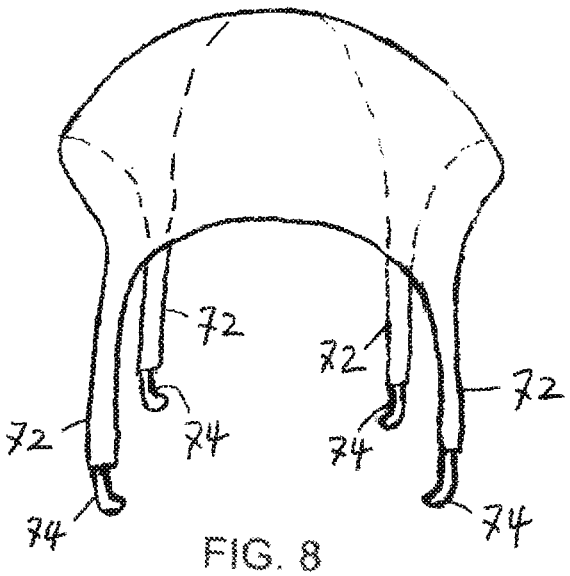
FIG. 8 illustrates a perspective view of a helmet attachment device.
Figure 9:
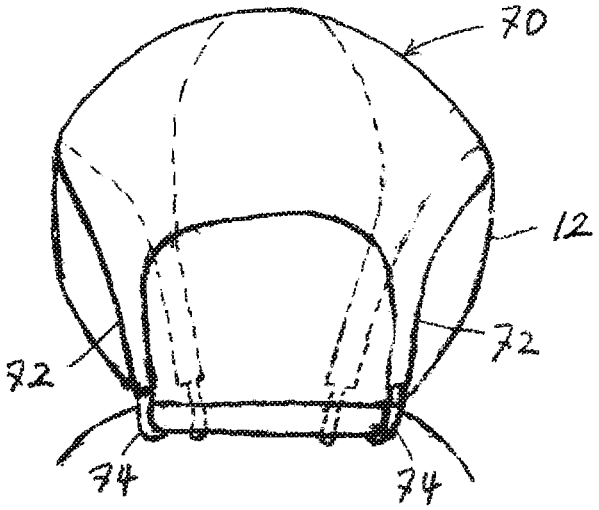
FIG. 9 illustrates a perspective view of the helmet attachment device of FIG. 8A secured to the survival helmet device and survival suit.
Figure 10A:
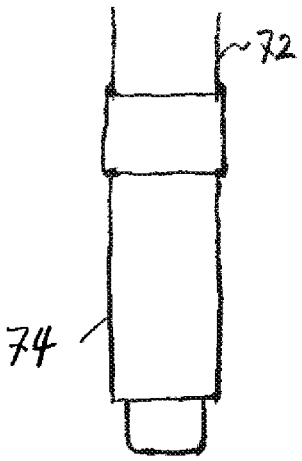
FIG. 10A illustrates a front elevational view of the elastomeric hook member.
Figure 10B:
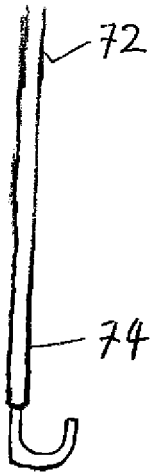
FIG. 10B illustrates a side elevational view of the elastomeric hook member.

Referring to FIG. 3, the exhale control member 34 is in the closed position for preventing airflow through the outlet opening 36 for the purpose of increasing the pressure within the survival suit 100 with user-exhaled air in order to increase the buoyancy of the user in an open body of water. Moreover, the heat of the exhaled air serves to warm the user's body within the survival suit 100 and helmet 12 for at least delaying the onset of hypothermia. In operation, as the user inhales through the breathing port on the mouthpiece 24, air enters the inner channel 16, passes through the one-way intake valve 18 and into inhale hose member 22, and enters the user's mouth through the mouthpiece 24. Referring additionally to FIGS. 6 and 7, the user exhales into mouthpiece 24 and the exhaled air enters aft cavity pocket 54A via tube member 52. Air cavity 54A is in fluid flow communication with rear air cavity 62 via tube member 58A. Air cavity pocket 54B is in fluid flow communication with rear air cavity pocket 62 via tube member 58B. The user continues to exhale air into air cavities 54A, 54B and 62 until a satisfactory buoyancy level is achieved. Flap valve member 56 permits one-way entry of air into air cavity 54A and is manually operable by the user. Release valve member 64 controls exit of air from air cavity 54B and is manually operable by the user. The release valve member 64 may be situated at the inside part of air cavity 54B and is operated by the user by pressing his hand on top of the survival suit at the place where the release valve member 64 is situated. Elastic straps 60 are used to secure air cavities 54A, 54B and 62 to the inner facing surface of the survival suit 100. The elastic straps are structured to stretch in response to increased airflow into air cavities 54A, 54B and 62.

Figure 4:
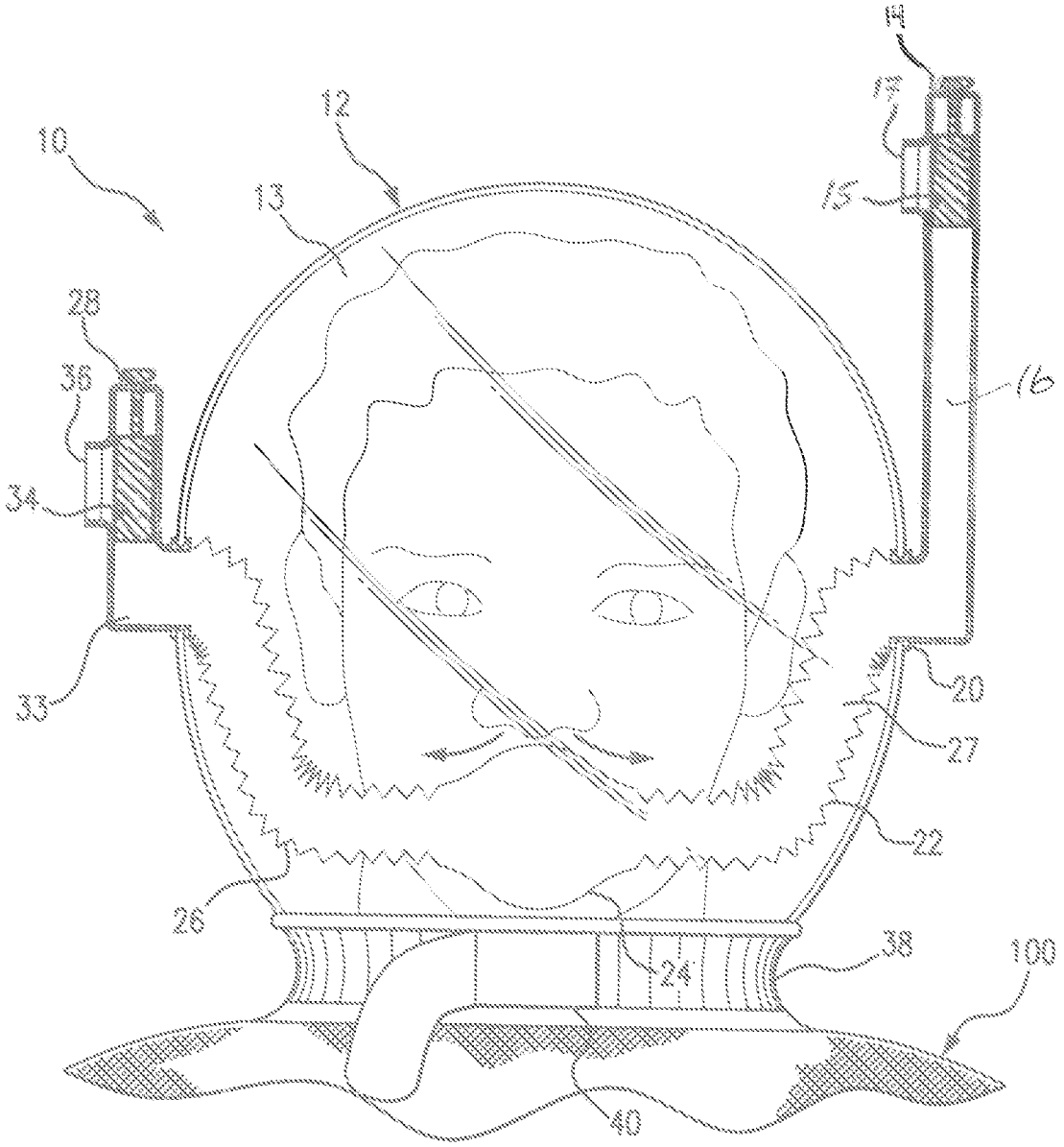
FIG. 4 is a front elevational view illustrating airflow through the survival helmet device and survival suit when the manually operated inhale member is in the closed position and the manually operated exhale member is in the closed position.

Referring to FIG. 4, the inhale control member 15 and the exhale control member 34 are in the closed position. This configuration permits the user to temporarily breath air from within the survival suit 100. The survival suit 100 holds an amount of oxygen suitable for approximately three minutes of breathing by the user.

Figure 5:
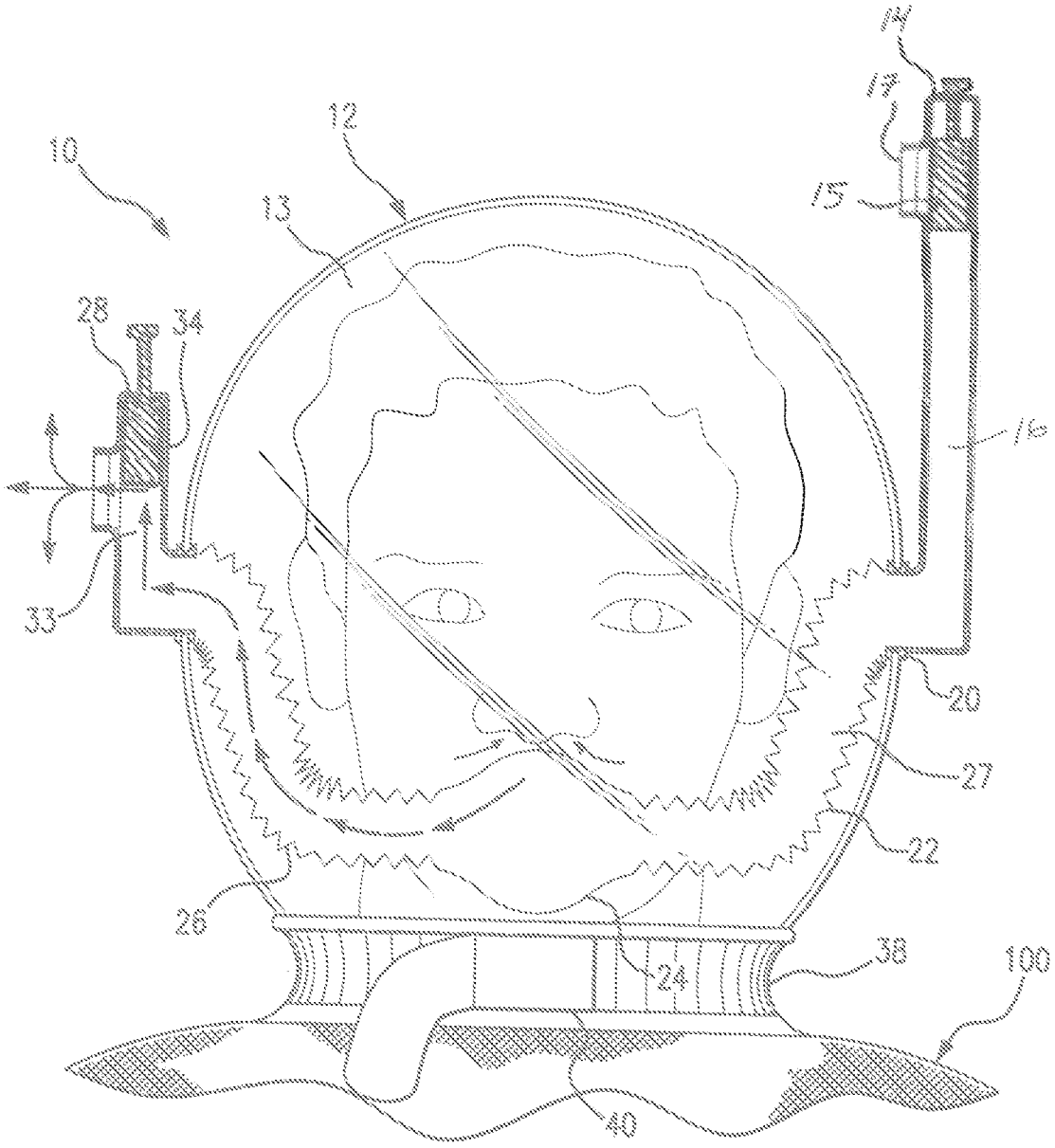
FIG. 5 is a front elevational view illustrating the survival helmet device.

Referring to FIG. 5, the user may desire to decrease the pressure within the interior cavity 13 of the helmet 12 and the suit 100 in order to decrease the buoyancy of the suit 100. In operation, the user closes the inhale control member 15 and the air is released from the suit 100 by opening the exhale control valve and disregarding the mouthpiece 24. The pressure of the surrounding water causes the air to exit the suit 100. The air in the airflow channel 27 passes through the one-way exhale valve 32 and into the inner cavity 33 of the control valve 28. The control member 34 is manually operable for controlling release of the exhaled airflow into the surrounding atmosphere. When the buoyancy level of the suit 100 is at a satisfactory level, the user reopens the inhale control member 15 and breaths through mouthpiece 25.

Referring to FIGS. 8-10B, in one embodiment, attachment of the helmet 12 to the metal collar 40 of the survival suit 100 utilizes securing member 70, which may be made from a durable, elastomeric material. Securing member 70 includes four straps 72 having hook members 74 at respective distal ends. The straps 72 extend from the main body of the securing member 70 and are equidistant from each other. In one embodiment, the hook members 74 are wide metal hooks. The hook members 74 are attachable to the metal collar 40 of the survival suit 100 by the survivor by keeping the hook member 74 in his hand and stretching it down to the curve of the metal collar 40. The hook members 74 are then attached to the curve of the metal collar 40 which keeps it in locked position by the stretched straps 72, which pull the hook members 74 against the curve of the metal collar 40 continually and simultaneously at the opposite sides of the helmet 12. This securing member 70 adds to the insulation of the helmet from leakage of water into the survival suit 100 by keeping the helmet 12 airtight. Moreover, the securing member 70 protects the helmet 12 from possible blows as well as the head of the user from possible sun exposure.

While the present invention has been shown and described in accordance with several preferred and practical embodiments, it is recognized that departures from the instant disclosure are contemplated within the spirit and scope of the present invention which are not to be limited except as defined in the following claims as interpreted under the Doctrine of Equivalents.

What is claimed is:

1. An immersion survival suit comprising:

a helmet surrounding an internal cavity and having an opening that is sized for passage of a user's head therethrough and into the internal cavity, and said helmet being securable to a survival suit;

an inhale conduit surrounding an inner channel extending between a top end and a bottom end of said inhale conduit;

an inlet opening formed by said inhale conduit approximate said top end for permitting atmospheric air to flow into said inner channel and a one-way inhale valve approximate said bottom end that is structured and disposed for permitting passage therethrough of air that is directed into the inner channel from the top end of said inhale conduit;

an inhale control member on said inhale conduit that is manually operable between an open position and a closed position for selectively permitting or preventing the passage of airflow through the inlet opening;

an inhale hose member in the internal cavity of said helmet, and said inhale hose member being secured to the bottom end of said inhale conduit at an inhale opening on said helmet;

an exhale hose member located in the internal cavity of said helmet;

a mouthpiece in fluid flow connection with said inhale hose member and the exhale hose member, and said mouthpiece forming a breathing port that is sized and configured for selective connection with the use mouth, wherein an airflow channel is formed by and extends the length of said inhale hose member, said mouthpiece, and said exhale hose member;

an exhale conduit surrounding an inner cavity extending between a top end and a bottom end of said exhale conduit and said exhale hose member being secured to the bottom end of said exhale conduit at an exhale opening on said helmet;

an outlet opening formed by said conduit approximate said top end for permitting air to flow from said inner cavity into the atmosphere and a one-way exhale valve approximate said bottom end that is structured and disposed for permitting passage therethrough of air from said airflow channel into said inner cavity of said exhale conduit;

an exhale control member on said exhale conduit that is manually operable between an open position and a closed position for selectively permitting or preventing the passage of airflow through the outlet opening;

at least one air cavity pocket secured to the inner facing surface of the survival suit;

a T-connector in said exhale hose member and a tube member having a first end extending from said T-connector and a second end extending from said at least one air cavity pocket, said tube member and said at least one air cavity pocket being in fluid flow communication with said airflow channel;

a flap valve member on said at least one air cavity pocket being operable to permit one-way entry of air into said at least one air cavity pocket and a release valve member on said at least one air cavity pocket that is operable to permit one-way exit of air into the survival suit;

wherein the user may selectively position each of said inhale and exhale control members in the open and close positions and selectively open and close said flap valve member and said release valve member to control air supply and buoyancy within said survival helmet device and the survival suit.

2. The immersion survival suit as recited in claim 1 wherein said helmet is at least partially transparent.

3. The immersion survival suit as recited in claim 1 wherein said helmet is made from plastic.

4. The immersion survival suit as recited in claim 1 further comprising a seal that is sized and configured for maintaining an airtight, fluid flow connection between the inner channel of said inhale conduit and said inhale hose member.

5. The immersion survival suit as recited in claim 1 further comprising a seal that is sized and configured for maintaining an airtight, fluid flow connection between said exhale hose member and the inner cavity of said exhale conduit.

6. The immersion survival suit as recited in claim 1 wherein said at least one air cavity pocket is secured to the inner facing surface of the survival suit by a plurality of elastic straps.

7. The immersion survival suit as recited in claim 1 wherein said at least one air cavity pocket comprises first and second front air pocket and a rear air pocket, said first front air cavity pocket and said rear air cavity, pocket being connected by a first tube member and said second front air cavity pocket and said rear air cavity pocket being connected by a second tube member, and wherein said flap valve member is on said first front air cavity pocket and said release valve member is on said second front air cavity pocket.

8. The immersion survival suit as recited in claim 1 wherein the survival suit includes a rigid collar.

9. The immersion survival suit as recited in claim 8 further comprising a securing member having a main body and a plurality of straps extending from said main body, each of said plurality of straps having a hook member at a distal end, said main body being sized and configured to be held against the top of said helmet and each of said plurality of hook members being structured and disposed to hook said rigid collar for maintain a downward force against said helmet.

* * * * *